United States Patent [19]

Taylor

[11] Patent Number: 4,934,973

[45] Date of Patent: Jun. 19, 1990

[54] LIFE PRESERVER

[76] Inventor: Benjamin A. Taylor, 513 Sanders, Hammond, La. 70403

[21] Appl. No.: 295,531

[22] Filed: Jan. 11, 1989

[51] Int. Cl.[5] ..... B63C 9/10

[52] U.S. Cl. ..... 441/117; 441/118

[58] Field of Search ..... 441/106, 119

[56] References Cited

U.S. PATENT DOCUMENTS

| | | | |
|---|---|---|---|
| 2,890,467 | 6/1959 | Cowell | 9/17 |
| 3,042,947 | 7/1962 | Bashore | 9/338 |
| 3,065,476 | 11/1962 | Brown | 9/345 |
| 3,366,984 | 2/1968 | Blanc, Jr. | 441/118 |
| 3,540,067 | 11/1970 | Deruaz | 9/342 |
| 3,727,249 | 4/1973 | Bonthelius | 9/312 |
| 3,988,795 | 11/1976 | Robertson | 9/338 |
| 4,654,016 | 3/1987 | Pendleton | 441/116 |

FOREIGN PATENT DOCUMENTS

| | | | |
|---|---|---|---|
| 1122997 | 8/1968 | United Kingdom | 441/118 |

*Primary Examiner*—Sherman D. Basinger

*Attorney, Agent, or Firm*—Fleit, Jacobson, Cohn, Price, Holman & Stern

[57] ABSTRACT

A yoke-type life preserver is provided including a relatively thick buoyant filler assembly loosely received within a flexible outer cover panel assembly for the life preserver and with the buoyant filler assembly being constructed to enable the life preserver to be readily flexed in order to conform to the torso curvature of a person wearing the life preserver. In addition, the yoke-type life preserver is constructed to be fully reversable and the attaching strap assembly of the life preserver is specifically designed to enable the strap to be secured about the wearer of the life preserver regardless of which side of the life preserver faces forwardly. In addition, the neck opening of the life preserver, at each end thereof, includes a flexible outstanding collar including a draw strap passing through a tubular collar hem to thereby enable the forwardly and upwardly facing collar of the life presever to be tightened about the wearer.

12 Claims, 2 Drawing Sheets

LIFE PRESERVER

BACKGROUND OF THE INVENTION

1. Field of the Invention

This invention relates to a reversable, yoke-style life preserver specifically designed to enable even persons unfamiliar with the life preserver to don the same in a short period of time, to provide floatation in addition to that conventionally provided in a life preserver, to enable the life preserver to more readily conform to different body contours, to enable the life preserver to quickly turn a face-down wearer to a face-up position and to prevent the life preserver from excessively riding up around the neck of the wearer.

2. Description of Related Art

Various different forms of life preservers heretofore have been provided including some of the general structural and operational features of the instant invention. Examples of these previously known life preservers are disclosed in U.S. Pat. Nos. 2,890,467, 3,042,947, 3,065,476, 3,540,067, 3,998,795, 3,727,249 and 4,654,016.

However, these previously known forms of life preservers do not include the overall combination of structural and operational features included in the instant invention.

SUMMARY OF THE INVENTION

The life preserver of the instant invention is basically of the yoke-type, but is considerably thicker than usual in front-to-rear direction for added buoyancy and incorporates a plurality of thin superposed buoyant panels loosely enclosed within an outer covering assembly and slightly shiftable relative to each other within the cover panel assembly in order to enable the life preserver to better conform to the shape of the torso of a person wearing the life preserver. In addition, selected buoyant panels have larger neck openings therein whereby the thickness of the life preserver immediately about the neck opening thereof may be reduced for wearer comfort and the life preserver is constructed in a manner whereby it is reversable and includes only a single body encircling retaining strap. In addition, both ends of the neck opening formed through the life preserver include flexible collars outstanding therefrom and equipped with draw straps extending through hem portions of the collars.

The main object of this invention is to provide a life preserver with increased buoyancy.

Another object of this invention is to provide a life preserver which may be more quickly properly donned by a person having little experience with life preservers.

Another very important object of this invention is to provide a life preserver which is reversable and therefore need not be properly oriented in front-to-rear direction before the life preserver is donned by the ultimate user.

A further object of this invention is to provide a life preserver constructed in a manner which will insure a person wearing the life preserver and in a face downward position in the water may be quickly turned to a face upward position with appreciable "free board".

A final object of this invention to be specifically enumerated herein is to provide a life preserver in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
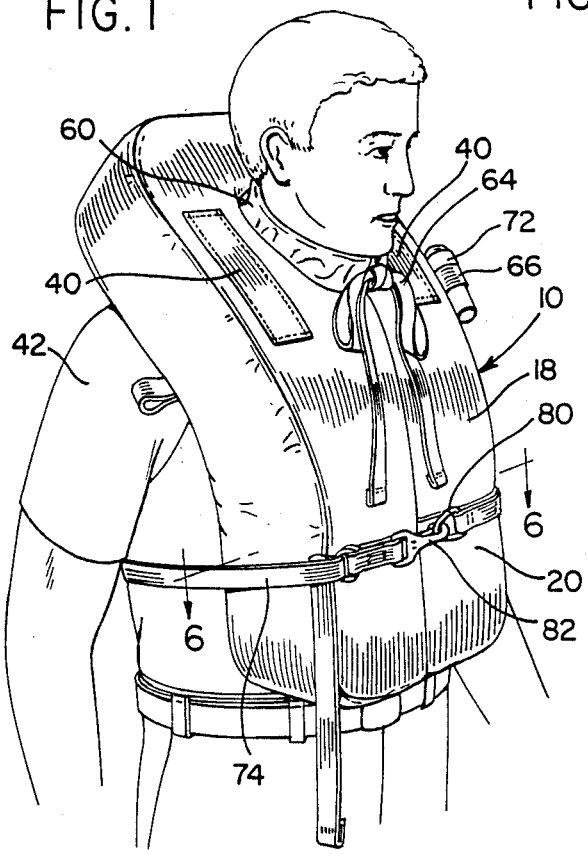
FIG. 1 is a perspective view of the life preserver of the instant invention properly worn by a user thereof and with the life preserver conforming in shape to the shape of the torso of the person wearing the life preserver.

Referring now more specifically to the drawings the numeral 10 generally designates the reversable yoke-type life preserver of the instant invention. The life preserver (when in use) comprises an upstanding assembly including upper and lower margins 12 and 14 interconnected by upstanding opposite side margins 16. In addition, the life preserver 10 defines opposite face sides 18 and 20, although the life preserver 10 is reversable.

The life preserver 10 includes an opening 22 extending through an upper portion thereof and includes a slit 24 extending downwardly from the lower portion of the opening 22 through the lower margin 14. The spacing between the face sides 18 and 20 is approximately 5", the width of the upper portion in which the opening 22 is formed is approximately 12" and the width of the lower portion adjacent the lower margin 14 is approximately 10", the diameter of the opening 22 being approximately 6 ½".

The life preserver 10 includes a buoyant filler assembly referred to in general by the reference numeral 30 consisting of a plurality of thin superposed buoyant panels 32 and 34 and a flexible outer cover panel assembly referred to in general by the reference numeral 36.

The cover panel assembly 36 conforms to the shape of and loosely encloses the stack of superposed buoyant panels 32 and 34 and may be constructed of any suitable flexible material having appropriate strength and resistance to chafing.

The outer surface of the upper margin of the cover assembly 36 includes a light reflective strip 38 secured thereto and each face side of the cover assembly includes further light reflective strips 40 secured thereover on opposite sides of the opening 22 and arranged lengthwise of the life preserver 10.

The buoyant panels 32 and 34 are constructed of closed cell plastic foam buoyancy material and may shift slightly relative to each other within the cover assembly 36. Thus, when the 5" thick life preserver 10 is curved in the manner illustrated in FIG. 1 of the drawings in order to conform to the torso shape of the wearer 42, individual buoyant panels 32 and 34 may shift relative to each other to reduce the stiffness of the filler assembly 30. In addition, those portions of the cover assembly 36 disposed on opposite sides of the slit 24 and constituting the lower margin 14 of the life preserver 10 are provided with water drain openings 44.

Figure 3:
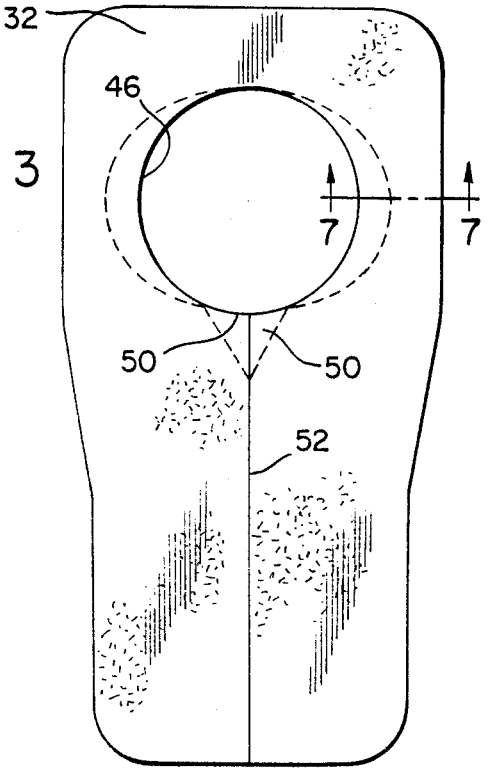
FIG. 3 is a plan view of the stack of buoyant panel members utilized as the buoyant filler assembly of the life preserver and with the larger neck opening equipped panel members shown in phantom lines.
Figure 4:
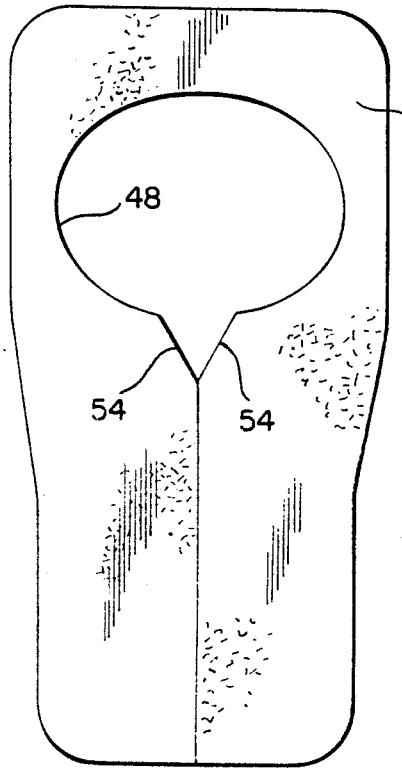
FIG. 4 is a plan view of one of the larger neck opening equipped panel members.
Figure 7:
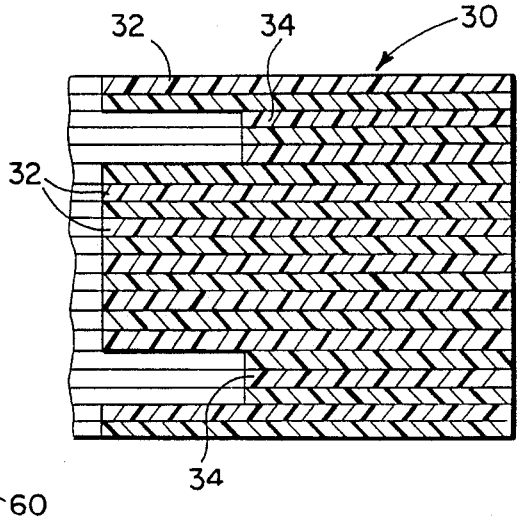
FIG. 7 is an enlarged fragmentary vertical sectional view taken substantially upon the plane indicated by the section line 7—7 of FIG. 3 and illustrating the preferred manner of stacking the buoyant panel members having different size neck openings therein.
Figure 8:
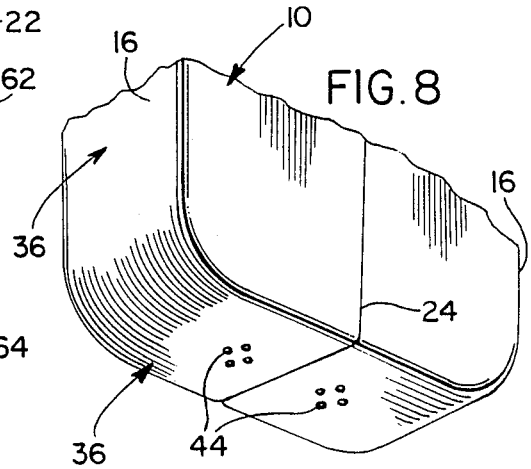
FIG. 8 is a fragmentary enlarged perspective view of the lower end of the life preserver illustrating the water drain openings in the flexible cover panel assembly thereof.

With attention now invited more specifically to FIGS. 3, 4 and 7, the stack of buoyant panels 32 and 34 equals twenty in number, each buoyant panel 32 and 34 therefore being generally ¼" in thickness.

The utilization of twenty ¼" thick panels as opposed to perhaps ten ½" thick panels enables each panel to be more flexible and smaller increments of shifting of each panel relative to the adjacent panels when the life preserver 10 is bowed or otherwise flexed to conform to the torso contour of the wearer. In addition, from FIG. 3 of the drawings, it may be seen that while the diameter of the circular neck opening 46 formed in each buoyant panel 32 is generally 7", the neck opening 48 formed in each buoyant panel 34 is elliptical and elongated transversely of the life preserver 10. The major axis diameter of the openings 48 is generally 9". In addition, although the buoyant panels 32 include relatively sharp corner portions 50 at the intersection of the slits 52 therein with the openings 46, the same corner portions of the buoyant panels 34 are heavily bevelled as at 54.

Although different stacking arrangements may be used when stacking the buoyant panels 32 and 34 in order to form the buoyant filler assembly 30, FIG. 7 illustrates that the opposite ends of the stack are defined by two superposed buoyant panels 32, the central portion of the stack is defined by ten superposed buoyant panels 32 and that three superposed buoyant panels 34 are disposed adjacent the ends of the stack of panels 32 and 34 with the central portion of ten superposed buoyant panels 32 disposed therebetween.

By stacking the panels 32 and 34 in the manner illustrated in FIG. 7 in order to form the buoyant filler assembly 30, the face sides 18 and 20 of the life preserver 10 may be displaced toward each other at opposite sides of the neck opening 22 of the life preserver 10: In addition, the heavily bevelled corners 54 of the buoyant panels 34 enable the corner portions of the life preserver 10 at the upper end of the slit 24 to be more readily compressed to further enhance the comfort of the wearer 42.

Figure 2:
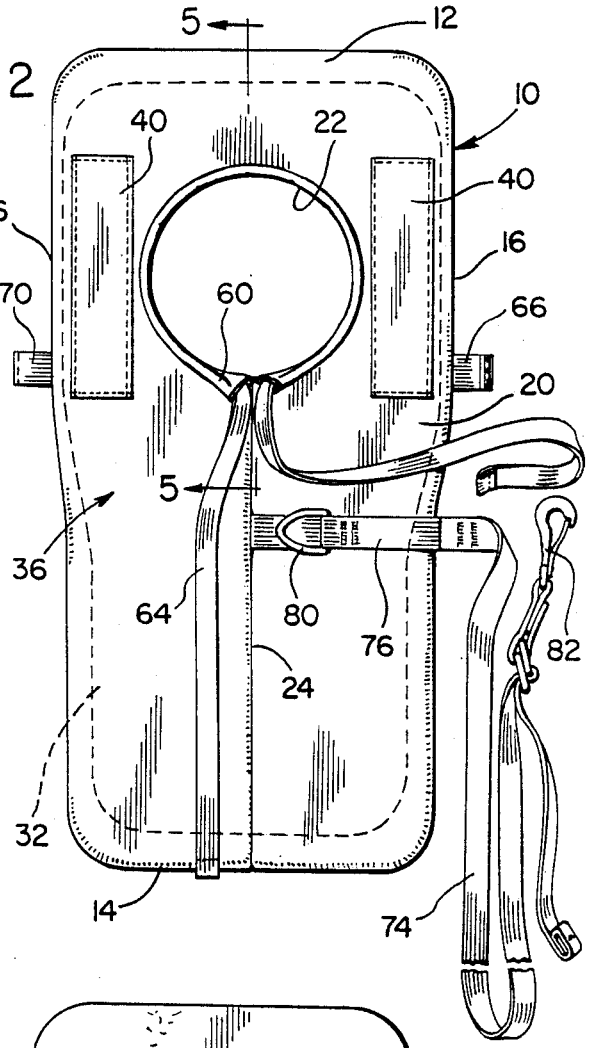
FIG. 2 is a front elevational view of the life preserver.
Figure 5:
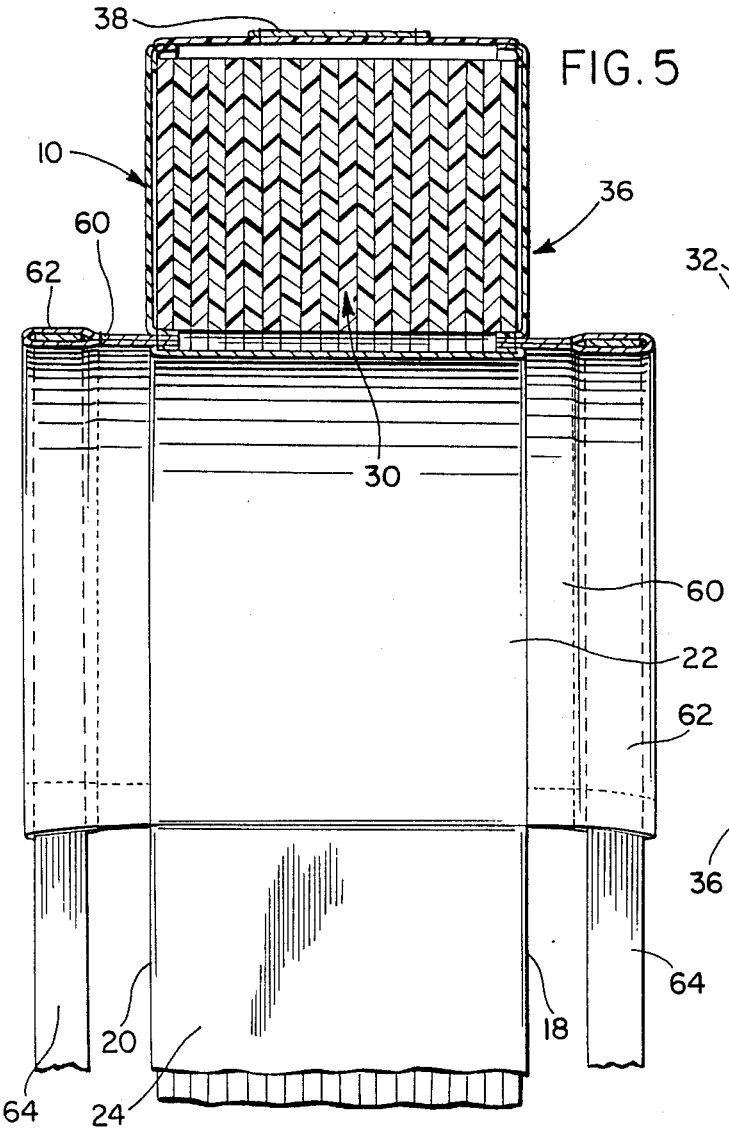
FIG. 5 is a fragmentary enlarged vertical sectional view taken substantially upon the plane indicated by the section line 5—5 of FIG. 2.

From FIGS. 1, 2 and 5 of the drawings it may be seen that the life preserver 10 includes a pair of flexible outstanding collars 60 at opposite ends of the opening. Each collar 60 extends about the opening 22 from the lower portion thereof on one side of the slit 24, around the opening 22 to the other side of the slit 24. In addition, each collar 60 includes a tubular hem portion 62 through which a suitable strap-type member 64 extends whereby whichever collar 60 is disposed immediately beneath the chin of the user 42 may have the tie strap 64 thereof tightened and tied to secure that collar 60 reasonably tightly about the neck of the user 42.

One side margin 16 of the life preserver 10 has a support loop 66 supported therefrom adjacent the face side 20 and the other side margin 16 of the life preserver 10 has a similar support loop 70 supported therefrom adjacent the face side 18. Each of the support loops 66 and 70 may be used to support a portable battery powered beacon light 72. Each loop is positioned such that it will always be disposed over the left shoulder of the user 42 regardless of which face side of the life preserver 10 faces forwardly.

Figure 6:
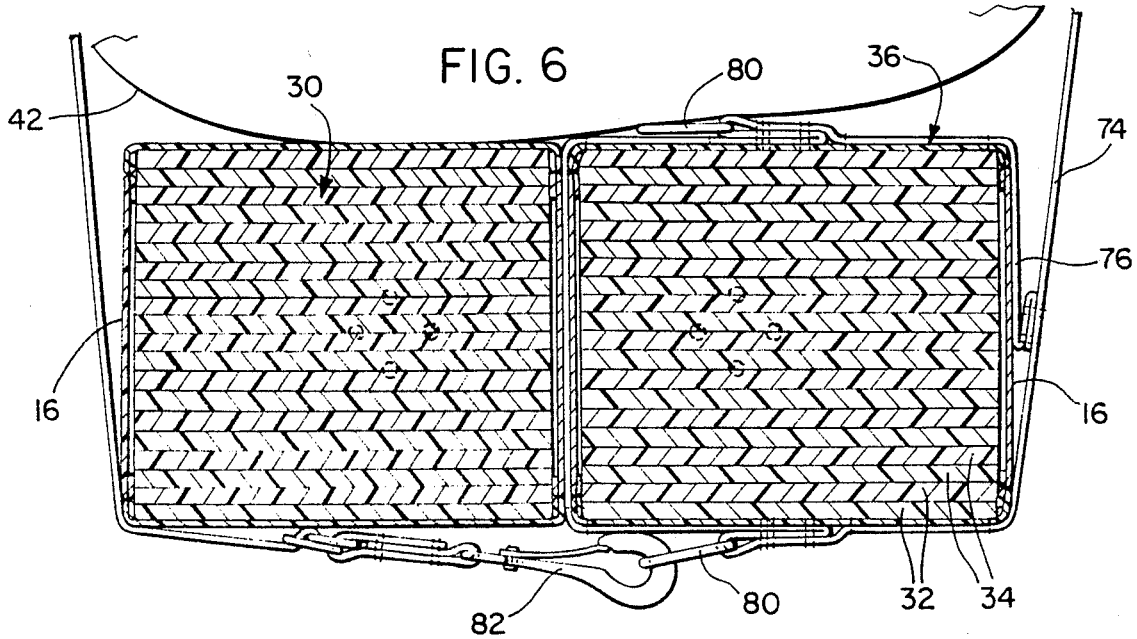
FIG. 6 is a fragmentary enlarged vertical sectional view taken substantially upon the plane indicated by the section line 6—6 of FIG. 1.

With attention now invited more specifically to FIGS. 1, 2 and 6 of the drawings, an elongated anchoring strap 74 is provided and includes a loop 76 on one end thereof which encircles a mid-height portion of the life preserver 10 on one side of the slit 24. The loop 76 is sewn to those underlying portions of the cover assembly 36 defining the opposite face sides 18 and 20 of the life preserver 10 as well as the underlying portion of the cover assembly 3 defining the corresponding side of the slit 24. However, those portions of the loop 76 overlying the portion of the cover assembly 36 defining the side margin 16 are not sewn to the cover assembly 36.

Each portion of the loop 76 sewn to and overlying a face side defining portion of the cover assembly 36 supports an anchor loop 80 therefrom and the other end of the strap 74 supports an anchor hook 82 therefrom. The anchor hook 82 is supported from the free end of the strap 84 for adjustable positioning therealong.

Thus, it may be seen that the single anchoring strap 74 of the life preserver 10 may be used to tightly secure the life preserver 10 to any size torso. The tie strap 64 disposed immediately beneath the chin of the user 42 is tightened and thus prevents the life preserver 10 from riding up on the head of the user, but the heavily bevelled areas 54 of the buoyant panels 34 and the oval shape of the openings 48 in the buoyant panels 34 enable the relatively thick life preserver 10 to fit comfortably about the neck of the user 42 and beneath the user's chin.

The unique attaching strap 74 and the manner in which the strap is secured to the cover assembly 36 and equipped with the two anchor loops 80 and the adjustably positionable anchor hook 82 provides an attaching means by which the life preserver 10 may be properly secured to the user 42 in either reversed position thereof. This is extremely important when time is of the essence in donning a life preserver and eliminates one cause of the wearer not being able to properly don the life preserver.

The utilization of the strap 74 to secure the life preserver 10 to the user 42 is the same regardless of which face side of the life preserver 10 faces forwardly. In addition, both face sides of the life preserver 10 are provided with a collar 60 and attendant tie straps 64 about the opening 22. Furthermore, even the specific positioning of the straps 66 and 70 insures that the wearer will not have difficulty in locating the proper anchor strap if a beacon light 72 is to be mounted from the life preserver 10.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In a life preserver of the upstanding, rectangular yoke-style having a generally circular neck receiving opening extending through said preserver and opening outward of the opposite face sides thereof adjacent the upper end of the life preserver and with a generally straight vertical slit extending from the bottom of said opening to the bottom of the preserver, said life preserver incorporating a buoyant filler assembly and a flexible cover panel assembly of corresponding shape disposed about and over said filler assembly, the improvement comprising a strap having a loop on one end encircling the portion of said life preserver on one side of said slit generally centrally intermediate the opposite ends of said slit and secured to the underlying portions of said cover panel assembly disposed over said face sides and extending through said slit, the portion of said loop extending over the side edge of said cover panel assembly remote from said slit being free of connections with said cover panel assembly and extending somewhat loosely thereover, said strap extending away from said loop at a location substantially centrally intermediate the length of said portion of said loop and being of a length greater than necessary to span the lower chest area of a person wearing said life preserver, the portion of said loop extending over and secured to those underlying portions of said cover panel assembly extending over said face sides of said life preserver including first strap end anchor means, the other end of said strap including second strap end anchor means releasably anchorable with said first strap end anchor means and adjustably positionable along said strap other end.

2. The life preserver of claim 1 wherein said filler assembly comprises a set of thin, superposed lightweight, flexible and resilient panels of buoyant material closely but loosely disposed in said cover panel assembly, of generally the same plan shape as said rectangular yoke-style preserver, slightly shiftable relative to each other within said cover panel assembly and with each panel including an opening therethrough corresponding to the first mentioned opening and a slit corresponding to the first mentioned slit.

3. The life preserver of claim 2 wherein said set of superposed panels includes selected panels thereof spaced inwardly from said face sides of said life preserver whose openings are greater in width, measured at right angles relative to said slit, than the width of the openings in the remaining panels.

4. The life preserver of claim 3 wherein said selected panels include at least one panel spaced inward from each panel defining a face side of said life preserver.

5. The life preserver of claim 4 wherein said selected panels each includes heavily bevelled corner portions in the areas thereof in which the slits therein open into the corresponding opening.

6. The life preserver of claim 1 wherein said cover panel assembly includes drain openings therethrough along the portions thereof extending across the lower end of said life preserver on opposite sides of said slit.

7. The life preserver of claim 1 wherein said cover panel assembly includes a flexible material collar disposed around each end of said opening and projecting outward of the corresponding face side of said life preserver, said collars each extending from one side of said slit, around the said opening to the other side of said slit, said collars each including means defining a tubular hem, and a draw strap in each hem.

8. In a life preserver of the upstanding rectangular yoke-style having a generally circular neck receiving opening extending through said preserver and opening outward of the opposite face sides thereof adjacent the upper end of the life preserver and with a generally straight slit extending from the bottom of said opening to the bottom of the life preserver, said life preserver incorporating a buoyant filler assembly and a flexible cover panel assembly of corresponding shape disposed about and over said filler assembly, the improvement comprising a strap having a first end anchored relative to the portion of said life preserver disposed on one side of said slit and supporting a first anchor member therefrom, the other end of said strap including a second anchor member releasably anchorable with the first anchor member and adjustably positionable along said second end of said strap, said filler assembly comprising a set of thin, superposed and lightweight panels of buoyant material closely but loosely disposed in said cover panel assembly, of generally the same plan shape as said rectangular yoke-style preserver, slightly shiftable relative to each other within said cover panel assembly and with each panel including an opening corresponding to the first mentioned opening and a slit corresponding to the first mentioned slit, said set of superposed panels including selected panels thereof spaced inwardly from said face sides of said life preserver whose openings are greater in width, measured at right angles relative to said slit, than the width of the openings in the remaining panels.

9. The life preserver of claim 8 wherein said selected panels include at least one panel spaced inward from each panel defining a face side of said life preserver.

10. The life preserver of claim 9 wherein said selected panels each includes heavily bevelled corner portions in the areas thereof in which the slits therein open into the corresponding opening.

11. The life preserver of claim 8 wherein said cover panel assembly includes drain openings therethrough along the portions thereof extending across the lower end of said life preserver on opposite sides of said slit.

12. In a life preserver of the upstanding, rectangular yoke-style having a generally circular neck receiving opening extending through said preserver and opening outward of the opposite face sides thereof adjacent the upper end of the life preserver and with a generally straight vertical slit extending from the bottom of said opening to the bottom of the preserver, said life preserver incorporating a buoyant filler assembly and a flexible cover panel assembly of corresponding shape disposed about and over said filler assembly, the improvement comprising a strap having a loop on one end encircling the portion of said life preserver on one side of said slit generally centrally intermediate the opposite ends of said slit and secured to the underlying portions of said cover panel assembly disposed over said face sides and extending through said slit, said strap extending away from said loop at a location substantially centrally intermediate the length of the said portion of said loop extending over the side edge of said cover panel assembly remote from said slit and being of a length greater than necessary to span the lower chest area of a person wearing said life preserver, the portions of said loop extending over and secured to those underlying portions of said cover panel assembly extending over said face sides of said life preserver each including first strap end anchor means, the other end of said strap including second strap end anchor means selectively releasably anchorable with said first strap end anchor means and adjustably positionable along said strap other end.

* * * * *